US005291162A

United States Patent [19]

Ito et al.

[11] Patent Number: 5,291,162

[45] Date of Patent: Mar. 1, 1994

[54] METHOD OF ADJUSTING FREQUENCY RESPONSE IN A MICROWAVE STRIP-LINE FILTER DEVICE

[75] Inventors: Kenji Ito; Hiroyuki Shimizu; Hotaka Oguchi, all of Nagoya, Japan

[73] Assignee: NGK Spark Plug Co., Ltd., Japan

[21] Appl. No.: 882,007

[22] Filed: May 13, 1992

[30] Foreign Application Priority Data

May 15, 1991 [JP] Japan ..... 3-110381
May 15, 1991 [JP] Japan ..... 3-110454

[51] Int. Cl.[5] ..... H01P 1/203
[52] U.S. Cl. ..... 333/205; 333/235
[58] Field of Search ..... 333/203-205, 333/219, 235, 246

[56] References Cited

U.S. PATENT DOCUMENTS 4,157,517 6/1979 Kneisel et al. ..... 333/205
4,583,064 4/1986 Makimoto et al. ..... 333/219
5,066,934 11/1991 Ito et al. ..... 333/205
5,084,684 1/1992 Shimizu et al. ..... 333/205
5,097,237 3/1992 Komazaki et al. ..... 333/219 X
5,105,173 4/1992 Itou ..... 333/204

FOREIGN PATENT DOCUMENTS 0396480 11/1990 European Pat. Off. ..... 333/204

*Primary Examiner*—Seungsook Ham
*Attorney, Agent, or Firm*—Larson and Taylor

[57] ABSTRACT

A method of adjusting a frequency response in a stripline filter device having a pair of stacked dielectric substrates with a plurality of stripline resonator conductors being sandwiched therebetween, wherein the frequency adjusting of the filter is performed by partially exposing the open circuit end of each of the resonator electrodes or a filamentary conductor for connecting the open end to the ground conducting layer on the outer surface of one of the dielectric substrates and then partially removing the partially exposed open circuit end of each resonator electrode or the partially exposed filamentary conductor connected to the open circuit end.

10 Claims, 7 Drawing Sheets

METHOD OF ADJUSTING FREQUENCY RESPONSE IN A MICROWAVE STRIP-LINE FILTER DEVICE

BACKGROUND OF THE INVENTION

The present invention relates to a method of adjusting a frequency response in a microwave stripline filter device which may be used as a band-pass filter for example.

A variety of microwave stripline filters that can be used as bandpass filters for microwaves are known in the art.

FIG. 1 of the accompanying drawings illustrates a microwave strip line filter of a known type which comprises a pair of dielectric substrates 1*a* and 1*b* made of dielectric ceramic material having a high dielectric constant and a lower dielectric loss such as $BaO\text{-}TiO_2$ or $BaO\text{-}TiO_2$-rare earth or the like, the dielectric substrates 1*a* and 1*b* being stacked to each other. The dielectric substrates 1*a* and 1*b* are provided with external ground conducting layers 2*a* and 2*b* on the peripheral portion and bottom surface thereof, respectively. On the upper surface of the lower dielectric substrate 1*a* are disposed a plurality of stripline resonator conducting layers 3*a* which operate as a filter element. Each resonator conducting layer 3*a* has one end connected to the ground conducting layer 2*a* to form a short circuit end, and the other end or an open circuit end spaced from the ground conducting layer 2*a*. The open circuit ends of the respective resonator conducting layers 3*a* are alternately disposed so as to form an interdigitated configuration. The upper dielectric substrate 1*b* is fixed on the lower dielectric substrate 1*a*, and the ground conducting layers 2*a* and 2*b* of the respective dielectric substrates are connected to each other. One example of such arrangements is disclosed in U.S. Pat. No. 4,157,517.

It is known that the response frequency of the stripline filter device of the above described type depends upon the dielectric constant of the used dielectric substrates and the dimensions of the respective resonator conductors. Upon the manufacturing of the filter devices the dielectric constant of the substrates and the dimensions of the resonator conductors are rigorously controlled. However, the manufactured filter devices inevitably show variations in terms of these factors and require an operation of frequency adjustment after the pair of dielectric substrates are assemblied.

The stripline filter device as illustrated in FIG. 1 is designed to initially have a resonance frequency lower than a desired value and after assemblying the pair of the dielectric substrates 1*a* and 1*b* to form the filter, the external conductor or ground conducting layer 2*b* provided on the upper surface of the upper substrate 1*b* is partially removed at regions 4 adjacent the open circuit ends of the resonator conducting layers 3*a* to reduce the stray capacitance between the external conducting layer 2*b* and the respective resonator conducting layers 3*a* thereby increasing the response frequency of the filter to the desired value.

With this adjusting method, however, the frequency response may be deviated again when the assembled filter body is contained in a casing after the adjustment of the frequency response is made as the removed regions 4 are brought to contact with or close to the upper inner wall of the outer casing so that the stray capacitance may be changed from the adjusted value.

In order to solve this problem, an attempt has been proposed in Japanese Patent Kokai No. 1-251801. According to a method of frequency adjustment disclosed in this reference, in a stripline filter in which a pair of dielectric substrates are stacked together with a plurality of resonance conductor strips arranged therebetween, openings are formed on the lateral sides of dielectric substrates at the positions facing the short circuit ends of the resonance conductor strips for adjustment of the response frequency.

Another solution for the problem has been proposed in Japanese Patent Kokai No. 2-292901 which discloses a method of frequency adjustment for a microwave stripline filter having a pair of dielectric substrates to be stacked, each provided on the outer surface with a ground conductor, together with a plurality of resonator electrodes arranged on the inner surface of at least one of the dielectric substrates, one end of each resonator electrode being connected to the the ground conductor to form a short circuit end, and the other end or an open circuit end being spaced from the ground conductor, wherein the ground conductors are partially removed at the locations on the lateral sides of the dielectric substrates facing the open ends of the resonator electrodes, at the locations connected to the short circuit ends of the resonator electrodes and at the locations where notches are formed on the lateral sides of the dielectric substrates, the notches facing the open ends of the resonator electrodes.

A further solution has been proposed in Japanese Patent Kokai No. 1-219580 which discloses a method of frequency adjustment for a stripline filter having a pair of dielectric substrates stacked together with a plurality of resonance conductor strips arranged therebetween. According to this method ground conductors are provided on the outer surface of each of the dielectric substrates except the lateral sides, the short circuit end of each of the resonator conductor strips is extended as far as one of the ground conductors along the lateral sides, the open end of each of the resonator conductors is removed together with a portion of the corresponding lateral side of either of the corresponding dielectric substrate, and a piece of corrective conductor is provided on the open circuit end of each of the resonator conductors.

The known methods of frequency adjustment as mentioned above have disadvantages. Firstly, while the method disclosed in Japanese Patent Kokai No. 2-251801 can reduce the response frequency of the filter by forming the openings on it for adjusting the response frequency, it can not raise the frequency once it is made too low. Besides, the proposed method involves cumbersome operations.

While the method disclosed in Japanese Patent Kokai No. 2-292901 can raise the response frequency of the filter, the extent to which it can adjust the frequency is rather limited and the effect of the frequency adjustment becomes poor when the open circuit end of each of the resonator conductors and the corresponding ground conductor are separated from each other by a considerable distance.

With the method disclosed in Japanese Patent Kokai No. 1-219580, the response frequency of the stripline filter can be increased to a considerable extent. However, the profile of the filter needs to meet certain given requirements if the method works effectively.

SUMMARY OF THE INVENTION

It is therefore an object of the present invention to provide a method of adjusting a frequency response of a microwave filter device of a stripline type which is free from the disadvantages mentioned above and capable of accurately adjusting the response frequency characteristics of the stripline filter over a wide range regardless of the profile of the filter.

According to one aspect of the present invention, there is provided a method of adjusting a frequency response of a microwave filter device of a stripline type including a pair of dielectric substrates each having a peripheral and outer surfaces provided with an external ground conducting layer, and a plurality of resonator electrodes arranged at least on the inner surface of one of the dielectric substrates, the resonator electrodes being sandwiched between the dielectric substrates, each resonator electrode having a short circuit end connected to the ground conductor on each substrate and an open circuit end spaced from the ground conductor on each substrate, characterized in that it comprises the steps of connecting the open end of each of the resonator electrodes with or bring the open end close to the ground conductor on the outer surface of one of the dielectric substrates by means of a filamentary conductor and then removing the filamentary conductor thereby tunning the filter device to a desired frequency response.

According to a second aspect of the present invention, there is provided a method of adjusting a frequency response of a microwave filter device of a stripline type including a pair of dielectric substrates each having a peripheral and outer surfaces provided with an external ground conducting layer, and a plurality of resonator electrodes arranged at least on the inner surface of one of the dielectric substrates, the resonator electrodes being sandwiched between the dielectric substrates, each resonator electrode having a short circuit end connected to the ground conductor on each substrate and an open circuit end spaced from the ground conductor on each substrate, characterized in that it comprises the steps of connecting the open circuit end of each of the resonator electrodes with or bring the open circuit end close to the ground conducting layer on the outer surface of one of the dielectric substrates by means of a filamentary conductor and then removing the portion of the filamentary conductor connected or brought close to the ground conductor with the portion of the ground conductor disposed close to said filamentary conductor portion thereby tunning the filter device to a desired frequency response.

According to a third aspect of the present invention, there is provided a method of adjusting a frequency response of a microwave filter device of a stripline type including a pair of dielectric substrates each having a peripheral and outer surfaces provided with an external ground conductor, and a plurality of resonator electrodes arranged at least on the inner surface of one of the dielectric substrates, the resonator electrodes being sandwiched between the dielectric substrates, each resonator electrode having a short circuit end connected to the ground conductor on each substrate and an open circuit end spaced from the ground conductor on each substrate, characterized in that it comprises the steps of positioning the open circuit end of each of the resonator electrodes so that it is partially exposed and then removing the exposed portion of the resonator electrodes thereby tunning the filter device to a desired frequency response.

Preferably, the open end of each resonator electrode may be partially exposed by setting the longitudinal size of one of the substrates smaller than that of the other substrate on which the resonator electrodes are provided.

Alternatively, the partially exposed portion of the open end of each resonator electrode may be formed by providing a notch on one of the substrates at a portion which corresponds to the open circuit end of each resonator electrode provided on the other substrate or extending the open end of each resonator electrode provided on the substrate to the lateral end portions of the substrate where no ground conducting layer is provided.

With the method according to the present invention, each exposed filamentary conductor used to connect the open end of each of the resonator electrodes to or bring it close to the corresponding ground conductor on the outer surface of the related substrate is very fine as compared with the resonator electrodes and therefore the length of each resonator electrode is the principal determinant of the resonance frequency. In other words, the exposed filamentary conductor does not significantly affect the response frequency characteristics of the corresponding resonator electrode. Besides, the exposed filamentary conductors may be directly removed by using an appropriate cutting means such as a drill or a laser trimmer thereby increasing the response frequency of the filter device. Since the operation of the frequency adjustment is carried out by selectively cutting off the exposed filamentary conductors, it offers a wide selection of locations for cutting operation and therefore of profiles for the filter.

The present invention will now be described by way of example with reference to the accompanying drawings.

DETAILED DESCRIPTION

Figure 1:
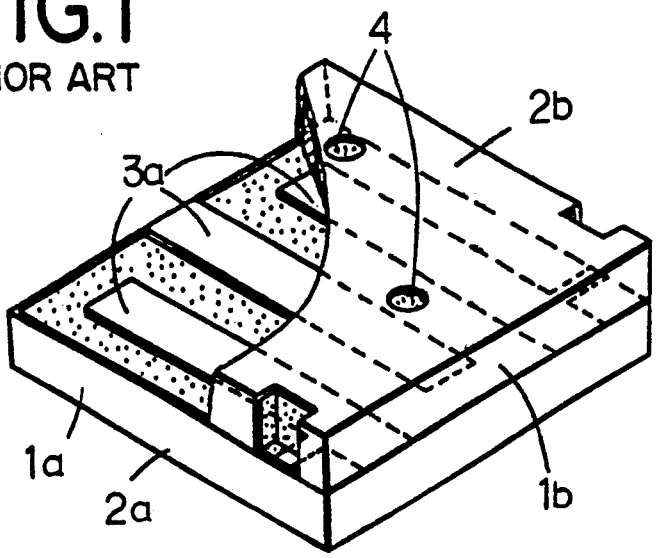
FIG. 1 PRIOR ART
FIG. 1 is a perspective partially cutaway view showing a prior art stripline filter device.
Figure 2:
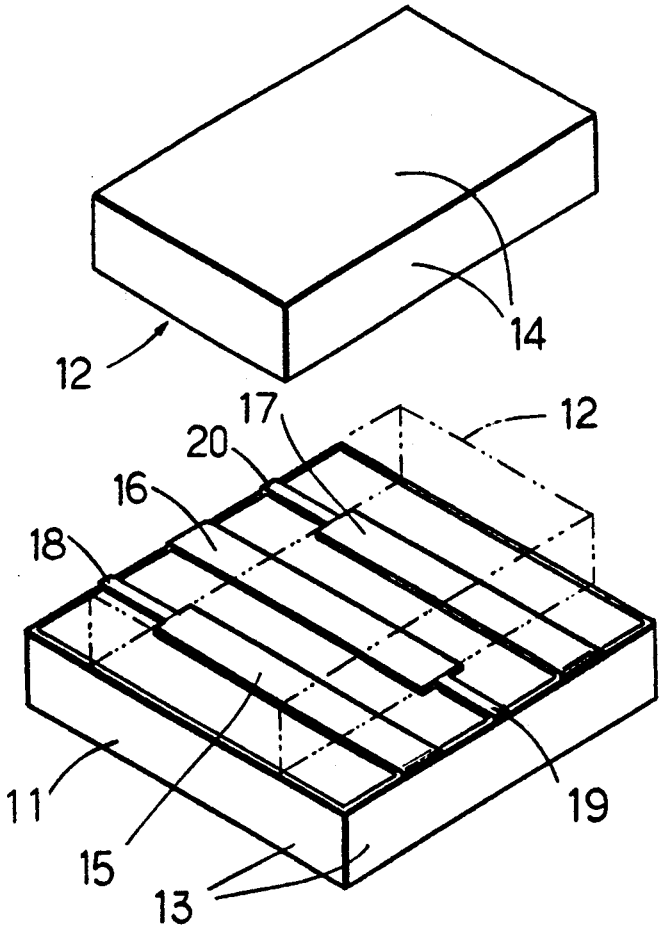
FIG. 2 is an exploded perspective view schematically showing a stripline filter device before a frequency adjusting is made in accordance with one embodiment of the present invention.
Figure 3:
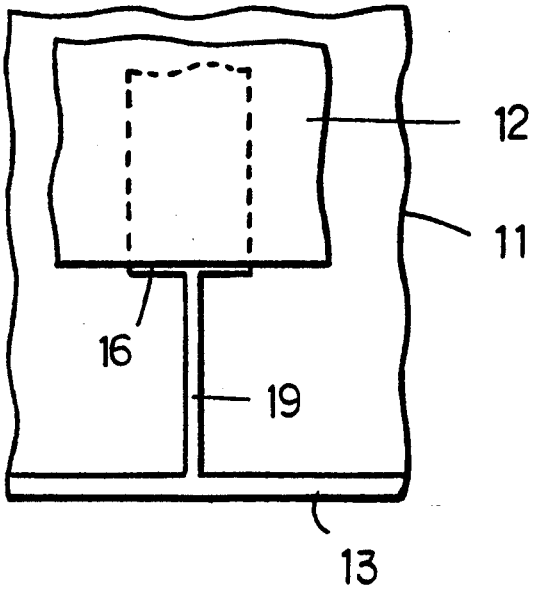
FIG. 3 is a enlarged partial plan view schematically showing a portion of the filter of FIG. 2 before frequency adjusting is made.
Figure 4:
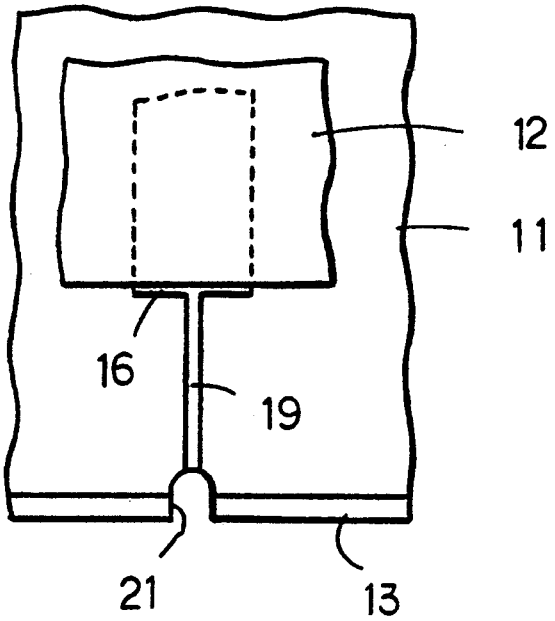
FIG. 4 is an enlarged partial plan view schematically showing the portion of the filter of FIG. 2 whose frequency response is adjusted.

Referring to FIGS. 2 to 4 showing a stripline filter constructed in accordance with one embodiment of the present invention, the illustrated filter comprises a pair of dielectric substrates 11 and 12 which are stacked to each other upon the assembling of the filter. Each of the dielectric substrates 11 and 12 may be of dielectric ceramic material having a high dielectric constant and a lower dielectric loss such as $BaO-TiO_2$, $BaO-TiO_2$-rare earth or the like. The lower dielectric substrate 11 is provided with an external ground conducting layer 13 on the peripheral portion and outer surface thereof. Similarly, the upper dielectric substrate 12 is provided with an external ground conducting layer 14 on the peripheral portion and upper or outer surface thereof. These ground conducting layers 13 and 14 may be formed by plating or vapor deposition.

A plurality of stripline resonator conducting layers 15, 16 and 17 which form a filter element are provided on the upper or inner surface of the lower dielectric substrate 11. Then, the upper dielectric substrate 12 is superimposed on the resonator conducting layers 15, 16 and 17 on the lower dielectric substrate 11, these components being rigidly fitted to one another. One end of each of the resonator conducting layers 15, 16 and 17 is connected with the ground conducting layer 13 to form a short-circuit end, while the other end is separated from the ground conducting layer 13 to form an open circuit end. As will be seen in FIG. 2, the open circuit ends of the resonator conducting layers 15, 16 and 17 are alternately directed to opposite directions so as to form an interdigital type filter arrangement. Also, the open circuit ends of the resonator conducting layers 15, 16 and 17 are connected with the ground conducting layer 13 by means of respective filamentary conductors 18, 19 and 20. The filamentary conductors 18, 19 and 20 are very fine as compared with the resonator conducting layers 15, 16 and 17 so that they may no& significantly affect the response frequency characteristics of the resonator conducting layers 15, 16 and 17.

The dielectric substrate 12 which is superimposed on the resonator conducting layers 15, 16 and 17 provided on the upper surface of the dielectric substrate 11 has a lateral dimension or width identical with the corresponding one of the dielectric substrate 11 in the direction perpendicular to the resonator conducting layers 15, 16 and 17 and a longitudinal dimension or length in the direction parallel to the resonator conducting layers 15, 16 and 17 substantially equal to the distance in that direction between the open circuit ends of the resonator conducting layers 15 and 17 and the open circuit end of the resonator conductor 16. Consequently, when the upper dielectric substrate 12 is superimposed in position as indicated by the broken lines in FIG. 2 or as shown in FIG. 3, the filamentary conductors 18, 19 and 20 are exposed to make the operation of cutting them off for frequency adjustment very easy.

The resonator conducting layers 15, 16 and 17 and the filamentary conductors 18, 19 and 20 can be formed on the lower dielectric substrate 11 by plating, vapor deposition or some other appropriate film forming technique as in the case of formation of the ground conducting layers 13 and 14.

The stripline filter having a configuration as described above is designed to show a response frequency slightly lower than the desired value in consideration of any deviations in the dielectric constants of the used substrates 11 and 12 and/or in the dimension of the resonator conducting layers 15, 16 and 17 upon the manufacturing. Therefore, the filter is subjected to an adjusting operation of its frequency characteristics after superimposing, assembling and fixing the components.

As shown by reference numeral 21 in FIG. 4, the filamentary conductor 19 extending from the open circuit end of the resonator conducting layer 16 may be directly and partially removed with a portion of the ground conducting layer 13 on the lateral side of the dielectric substrate 11 by using an appropriate means such as a drill or a laser trimmer in order to increase the response frequency of the resonator conducting layer 16. In this connection, since the respective filamentary conductors 18, 19 and 20 are exposed, it should be appreciated that the removing or cutting operation can be carried out without difficulty for frequency adjustment. The response frequency of the filter device can be easily and exactly brought to the intended desirable level by sequentially performing the adjusting operations for the respective resonator conducting layers.

Figure 5:
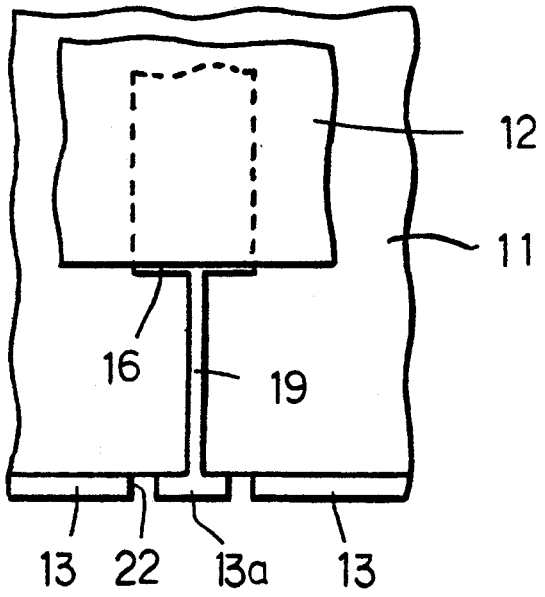
FIG. 5 is an enlarged partial plan view schematically showing another stripline filter device before a frequency adjusting is made in accordance with a modified embodiment of the present invention.
Figure 6:
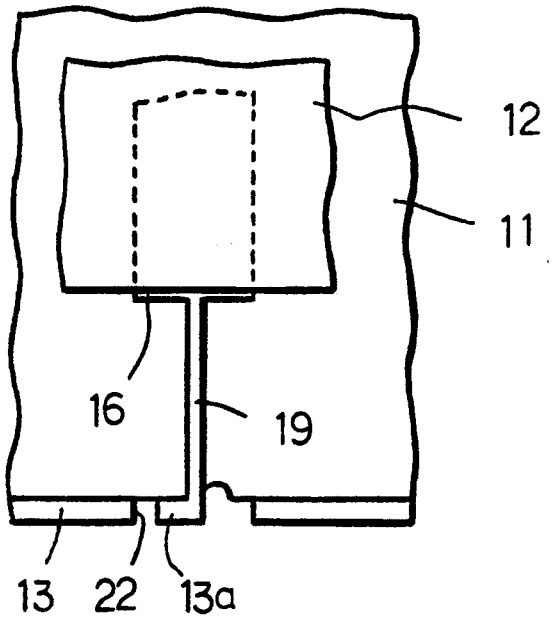
FIG. 6 is a enlarged partial plan view schematically showing the portion of the filter of FIG. 5 whose frequency response is adjusted.

Alternatively, as illustrated in FIGS. 5 and 6, gaps 22 are formed in the ground conducting layer 13 on the lateral side of the dielectric substrate 11 for separating a portion 13*a* of the ground conducting layer 13 directly connected with the associated filamentary conductor (only the filamentary conductor 19 is shown in FIGS. 5 and 6) from the rest of the ground conducting layer 13. In this case, the response frequency of the filter may be adjusted by partially removing the portion 13*a* of the ground conducting layer 13 directly connected with the filamentary conductor 19. In this connection it may needless to say that the above statement is applicable to both the filamentary conductors 18 and 20.

Figure 7:
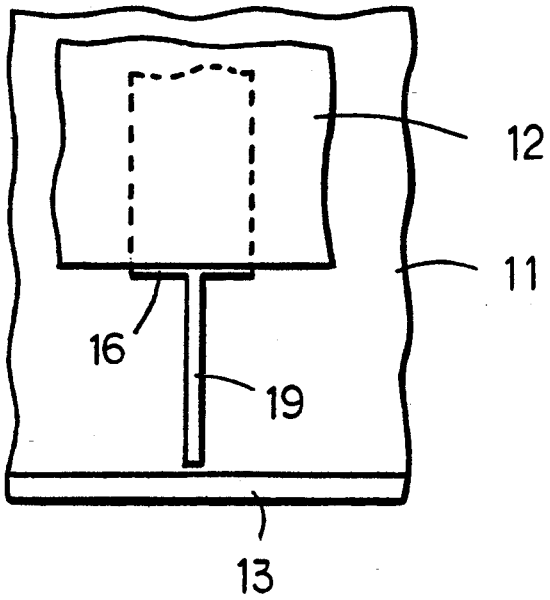
FIG. 7 is an enlarged partial plan view schematically showing a portion of a further filter device before frequency adjusting is made in accordance with another modified embodiment of the present invention.
Figure 8:
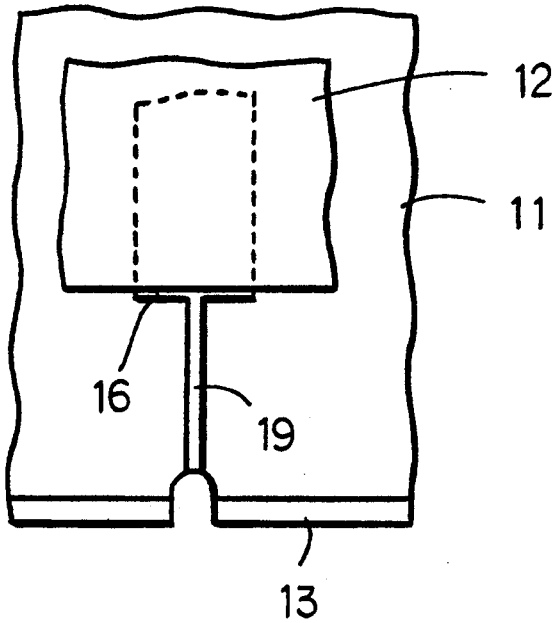
FIG. 8 is an enlarged partial plan view schematically showing the portion of the filter of FIG. 7 whose frequency response is adjusted.

While the filamentary conductors 18, 19 and 20 for frequency adjustment are connected to the ground conducting layer 13 in the above description, they may alternatively be terminated at respective locations close to the ground conducting layer 13 on the related lateral sides of the dielectric substrate 11 as illustrated in FIG. 7 (where only the filamentary conductors 19 is shown). In this case, the response frequency of the filter may be adjusted by partially and directly removing the end portions of the filamentary conductors along with corresponding portions of the ground conducting layer 13 from outside as illustrated in FIG. 8 (where only the filamentary conductors 19 is shown).

Furthermore, the filamentary conductors 18, 19 and 20 are exposed in the illustrated embodiments. However, a large upper dielectric substrate 12 that extends over the entire upper surface of the lower dielectric substrate 11 may be alternatively used to cover the filamentary conductors 18, 19 and 20. If such is the case, the filamentary conductors 18, 19 and 20 may be partly cut off with the substrate 12 from the outside by a drill or the like.

Figure 9:
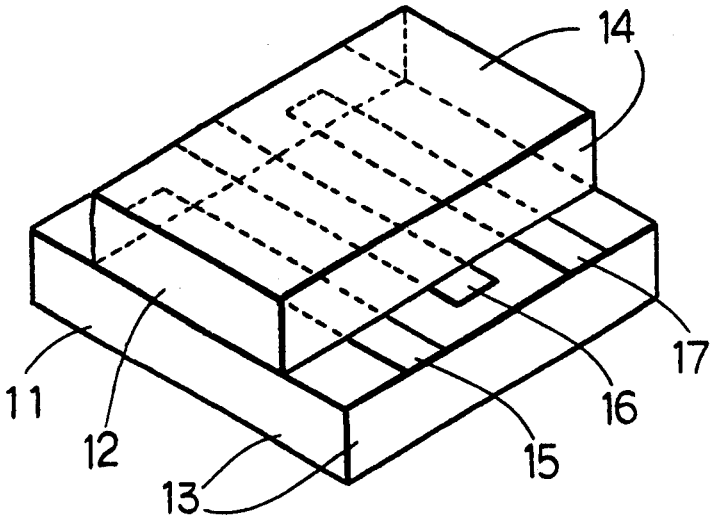
FIG. 9 is a perspective view schematically showing a still further stripline filter device to which the present invention is carried out.

Referring now to FIG. 9, there is illustrated another embodiment of the present invention in which components identical or similar to those of the first embodiment illustrated in FIG. 2 are given same reference numerals as those used in the first embodiment.

The stripline filter illustrated in FIG. 9 is similar to one of FIG. 2 with the exception of the arrangement of respective resonator electrodes. The illustrated filter comprises a pair of piezoelectric substrates 11 and 12 each of which may be of dielectric ceramic material having a high dielectric constant and a lower dielectric loss such as $BaO\text{-}TiO_2$, $BaO\text{-}TiO_2$-rare earth or the like. The dielectric substrates 11 and 12 are provided with external ground conducting layers 13 and 14 on the peripheral portions and outer surfaces thereof, respectively. These ground conducting layers 13 and 14 may be formed by plating or vapor deposition.

A plurality of stripline resonator conducting layers 15, 16 and 17 which form a filter element are provided on the upper or inner surface of the lower dielectric substrate 11. One end of each of the resonator conducting layers 15, 16 and 17 is connected with the ground conducting layer 13 to form a short circuit end, while the other end is separated from the ground conducting layer 13 to form an open circuit end.

The dielectric substrate 12 has a lateral dimension or width equal to the corresponding one of the dielectric substrate 11 in the direction perpendicular to the resonator conducting layers 15, 16 and 17, but the longitudinal dimension or length of the dielectric substrate 12 is determined so that the Open circuit end of each of the resonator conducting layers 15, 16 and 17 is partially exposed when the dielectric substrate 12 is superimposed on the resonator conducting layers 15, 16 and 17 provided on the dielectric substrate 11, thereby making the frequency adjustment operation very easy.

As in the case of the embodiment illustrated in FIG. 2, the resonator conducting layers 15, 16 and 17 can be formed on the lower dielectric substrate 11 by plating, vapor deposition or some other appropriate film forming technique.

With the stripline filter thus constructed, there may be any deviations in the dielectric constants of the used substrates 11 and 12 and/or in the dimension of the resonator conducting layers 15, 16 and 17 upon the manufacturing, and then the filter is designed to show a response frequency slightly lower than the desired value. It is therefore necessary to adjust the frequency of the filter after the dielectric substrates 11 and 12 are assembled with the resonator conducting layers 15, 16 and 17 sandwiched therebetween. To this end, the exposed portion of the open circuit end of each resonator conducting layer is directly and partially removed by using an appropriate cutting means such as a drill or a laser trimmer thereby increasing the response frequency of that resonator conducting layer. Since the portion to be removed of the open circuit end of each resonator conducting layer is exposed, the removing or cutting operation can be carried out without difficulty for frequency adjustment. The response frequency of the filter device can be easily and exactly brought to the intended level by sequentially performing the removing operations for the respective resonator conducting layers.

Figure 10:
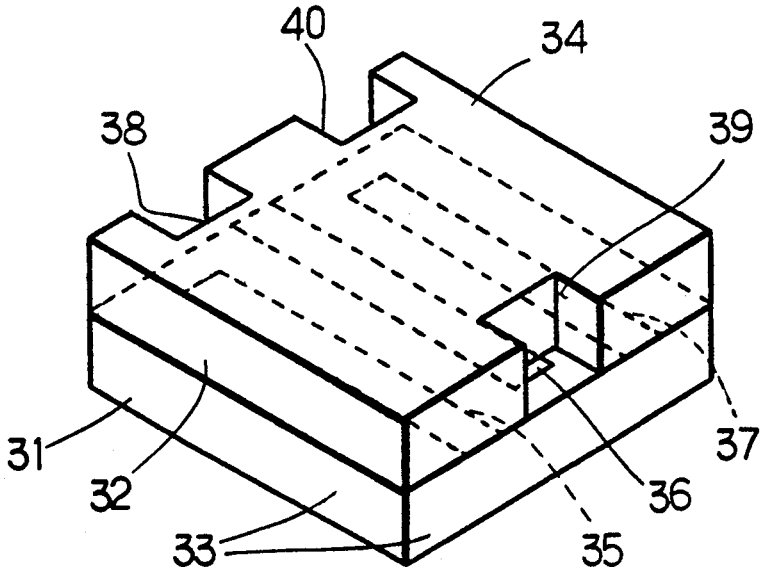
FIG. 10 is a perspective view schematically showing a further stripline filter device according to a further embodiment of the present invention.
Figure 11:
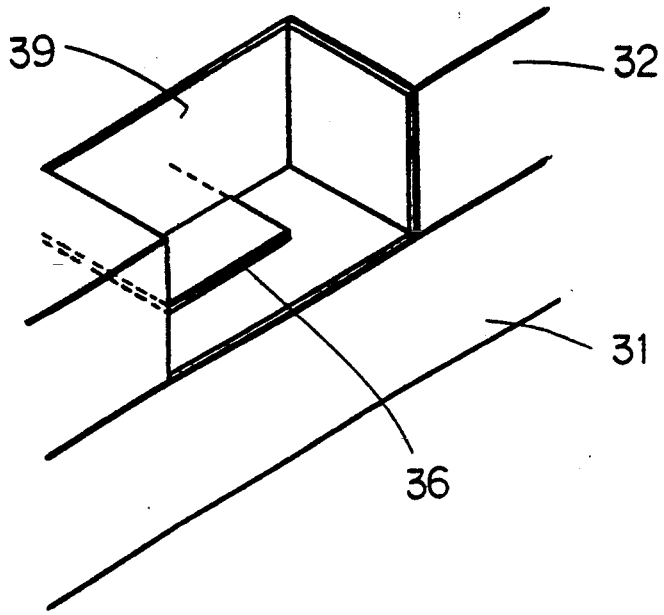
FIG. 11 is an enlarged partial perspective view schematically showing the portion of the filter of FIG. 10 to which frequency adjusting operation is applied.

FIGS. 10 and 11 illustrate a further embodiment of the present invention.

The illustrated filter comprises a pair of dielectric substrates 31 and 32 each of which is made of similar material to that of substrates 11 and 12 in the above mentioned embodiment and has a peripheral portion and outer surface provided with an external ground conducting layer 33 (34). In this case, the upper dielectric substrate 32 has the same size as that of the lower dielectric substrate 31. On the upper surface of the lower dielectric substrate 31 are provided a plurality of stripline resonator conductor layers 35, 36 and 37 which form a filter element. The ground conducting layers 33 and 34 and the resonator conductor layers 35, 36 and 37 may be formed by means of plating, vapor deposition or some other appropriate film forming technique.

One end of each of the resonator conducting layers 35, 36 and 37 is connected with the ground conducting layer 33 to form a short circuit end, while the other end is separated from the ground conducting layer 33 to form an open circuit end. The open circuit ends of the respective resonator conducting layers 35, 36 and 37 are alternately disposed so as to form an interdigital type resonator. In order to partially expose the open circuit ends of the respective resonator conducting layers 35, 36 and 37, as shown in FIG. 10, rectangular recesses 38, 39 and 40 are respectively provided on the portions of the dielectric substrate 32 which are opposite to these open circuit ends. Therefore, when the dielectric substrates 31 and 32 are assembled with the resonator conducting layers 35, 36 and 37 sandwiched therebetween, the open circuit ends of the respective resonator conducting layers 35, 36 and 37 are partially exposed so that the frequency adjusting operation can be easily performed. In this embodiment the adjustment of the frequency response can be performed by partially removing the exposed portions of the open circuit ends of the respective resonator conducting layers 35, 36 and 37 as in the case of FIG. 9.

Figure 12:
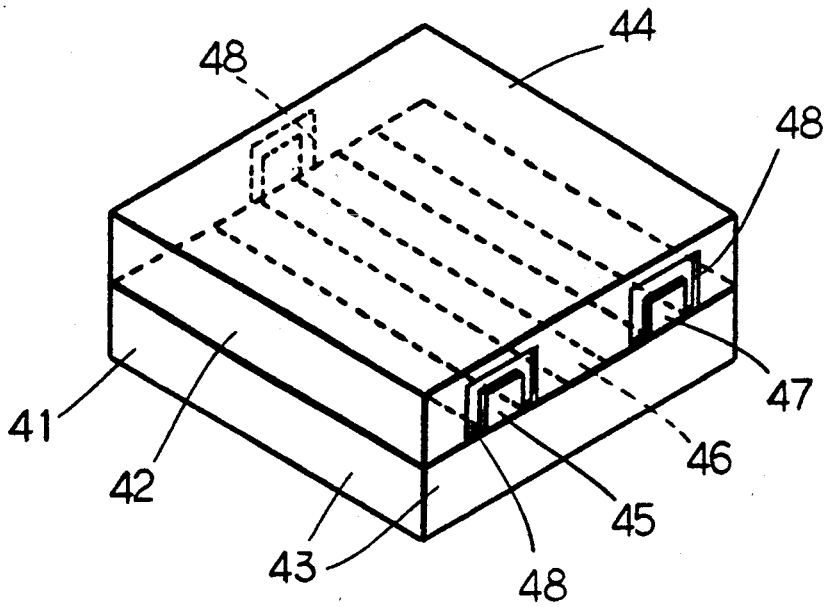
FIG. 12 is a perspective view schematically showing a further stripline filter device according to a further embodiment of the present invention.
Figure 13:
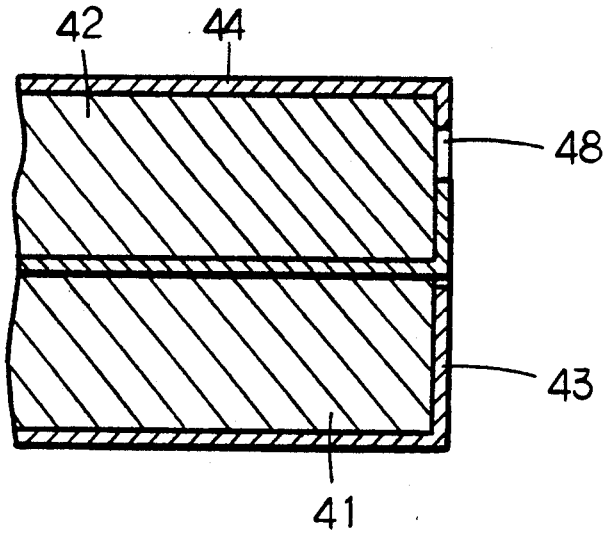
FIG. 13 is an enlarged partial sectional view schematically showing the portion of the filter of FIG. 12 to which frequency adjusting operation is applied.

Referring to FIGS. 12 and 13 there is a still further embodiment of the present invention in which a pair of dielectric substrates 41 ans 42 are designed to have the same size as each other, each of which is provided with an external ground conducting layer 43 or 44 on the peripheral portion and outer surface thereof. One of the dielectric substrates 41 and 42 is provided with a plurality of stripline resonator conducting layers 45, 46 and 47. These layers may be formed by means of plating, vapor deposition or some other appropriate film forming technique.

Each of the stripline resonator conducting layers 45, 46 and 47 has an open circuit end which is extended to a portion 48 of the end surface of the dielectric substrate 42 where no ground conducting layer is provided. Consequently, the open circuit ends of the respective resonator conducting layers 45, 46 and 47 are partially exposed. The exposed open circuit end portions are partially removed for performing the frequency response adjustment of the filter.

While the resonator conducting layers are formed only on one of the substrates in the illustrated embodiments, the method of the present invention is also applicable to a strip line filter device where resonator conducting layers are symmetrically formed on both dielectric substrates or a strip line filter device having a resonator conducting layer arrangement of a type other than the interdigital-type such as a column-line-type. It may be needless to say that the method of the present invention is also applicable to a stripline filter device comprising more or less than three resonator conductors.

As described above, according to the present invention the frequency adjusting of the filter is performed by partially exposing the open circuit end of each of the resonator electrodes or the filamentary conductor for connecting the open end to the ground conducting layer on the outer surface of one of the dielectric substrates and then partially removing the partially exposed open circuit end of each resonator electrode or the partially exposed filamentary conductor connected to the open circuit end. Therefore, the present invention has an advantage that it has a remarkable effect of frequency adjustment over a wide range as compared a conventional method which utilizes stray capacitances.

In case the present invention is applied to a strip line filter device having partially exposed filamentary conductors, not only the operation of removing or cutting off the filamentary conductors and hence the operation of the frequency adjustment can be easily carried out, but also it offers a wide selection of locations for removing or cutting operation and therefore of profiles for the filter.

It is to be understood that the present invention is not limited to the particular embodiments described and that numerous modifications and alterations may be made by those skilled within the scope of the invention claimed.

We claim:

1. A method of adjusting a frequency response of a microwave filter device of a stripline type including a pair of dielectric substrates each including an inner surface and each having peripheral and outer surfaces provided with an external ground conducting layer thereon, and a plurality of resonator electrodes arranged at least on the inner surface of one of the dielectric substrates, the resonator electrodes being sandwiched between the dielectric substrates, each resonator electrode having a short circuit end connected to the ground conductor on each substrate and an open circuit end spaced from the ground conductor on each substrate, said method comprising the steps of:

connecting the open circuit end of each of the resonator electrodes with the ground conductor on the outer surface of one of the dielectric substrates by means of a filamentary conductor;

positioning the filamentary conductor for each of said resonator electrodes so that the filamentary conductor is exposed with respect to one of the dielectric substrates; and removing each of the exposed filamentary conductors so as to thereby tune the filter device to a desired frequency response.

2. A method as claimed in claim 1, wherein said removing step is performed by using a cutting tool or laser beam machining.

3. A method of adjusting a frequency response of a microwave filter device of a stripline type including a pair of dielectric substrates each including an inner surface and each having peripheral and outer surfaces provided with an external ground conducting layer thereon, and a plurality of resonator electrodes arranged at least on the inner surface of one of the dielectric substrates, the resonator electrodes being sandwiched between the dielectric substrates, each resonator electrode having a short circuit end connected to the ground conductor on each substrate and an open circuit end spaced from the ground conductor on each substrate, said method comprising the steps of:

bringing the open circuit end of each of said resonator electrodes close to the ground conductor on the outer surface of one of the dielectric substrates by means of a filamentary conductor;

positioning the filamentary conductor for each of said resonator electrodes so that the filamentary conductor is exposed with respect to one of the dielectric substrates; and removing each exposed filamentary conductor to thereby tune the filter device to a desired frequency response.

4. A method as claimed in claim 3, wherein said removing step is performed by using a cutting tool or laser beam machining.

5. A method of adjusting a frequency response of a microwave filter device of a stripline type including a pair of dielectric substrates each including an inner surface and each having a peripheral and outer surfaces provided with an external ground conducting layer thereon, and a plurality of resonator electrodes arranged at least on the inner surface of one of the dielectric substrates, the resonator electrodes being sandwiched between the dielectric substrates, each resonator electrode having a short circuit end connected to the ground conductor on each substrate and an open circuit end spaced from the ground conductor on each substrate, said method comprising the steps of:

connecting the open circuit end of each of the resonator electrodes with the ground conductor on the outer surface of one of the dielectric substrates by means of a filamentary conductor;

positioning the filamentary conductor for each of said resonator electrodes so that the filamentary conductor is exposed with respect to one of the dielectric substrates; and removing the portion of the filamentary conductor connected to the ground conducting layer along with a portion of the ground conducting layer disposed close to said filamentary conductor portion so as to thereby tune the filter device to a desired frequency response.

6. A method as claimed in claim 5, wherein said removing step is performed by using a cutting tool or laser beam machining.

7. A method of adjusting a frequency response of a microwave filter device of a stripline type including a pair of dielectric substrates each including an inner surface and each having a peripheral and outer surfaces provided with an external ground conducting layer thereon, and a plurality of resonator electrodes arranged at least on the inner surface of one of the dielectric substrates, the resonator electrodes being sandwiched between the dielectric substrates, each resonator electrode having a short circuit end connected to the ground conductor on each substrate and an open circuit end spaced from the ground conductor on each substrate, said method comprising the steps of:

bringing the open circuit end of each of said resonator electrodes close to the ground conductor on the outer surface of one of the dielectric substrates by means of a filamentary conductor;

positioning the filamentary conductor for each of said resonator electrodes so that the filamentary conductor is exposed with respect to one of the dielectric substrates; and removing the portion of the filamentary conductor brought close to the ground conducting layer along with a portion of the ground conducting layer disposed close to said filamentary conductor portion so as to thereby tune the filter device to a desired frequency response.

8. A method as claimed in claim 7, wherein said removing step is performed by using a cutting tool or laser beam machining.

9. A method of adjusting a frequency response of a microwave filter device of a stripline type including a pair of dielectric substrates each including an inner surface and each having a peripheral and outer surfaces provided with an external ground conductor thereon, and a plurality of resonator electrodes arranged at least on the inner surface of one of the dielectric substrates, the resonator electrodes being sandwiched between the dielectric substrates, each resonator electrode having a short circuit end connected to the ground conductor on each substrate and an open circuit end spaced from the ground conductor on each substrate, said method comprising the steps of:

partially exposing the open circuit end of each of the resonator electrodes by providing a notch on one of the substrates at a portion which corresponds to the open circuit end of each resonator electrode provided on the other substrate; and removing the exposed portion of the resonator electrodes so as to thereby tune the filter device to a desired frequency response.

10. A method of adjusting a frequency response of a microwave filter device of a stripline type including a pair of dielectric substrates each including an inner surface and each having peripheral and outer surfaces provided with an external ground conductor thereon, and a plurality of resonator electrodes arranged at least on the inner surface of one of the dielectric substrates, the resonator electrodes being sandwiched between the dielectric substrates, each resonator electrode having a short circuit end connected to the ground conductor on each substrate and an open circuit end spaced from the ground conductor on each substrate, said method comprising the steps of:

partially exposing the open circuit end of each of the resonator electrodes by extending the open circuit end to a lateral end portion of the substrate where no ground conductor is provided; and removing the exposed portion of the open circuit end of the resonator electrodes so as to thereby tune the filter device to a desired frequency response.

* * * * *